United States Patent [19]

Koine

[11] 4,391,180

[45] Jul. 5, 1983

[54] METHOD AND MEANS FOR CONTROLLING THE FIRING RATE FROM A MACHINE GUN

[75] Inventor: Richard Koine, Ratingen, Fed. Rep. of Germany

[73] Assignee: Rheinmetall GmbH, Duesseldorf, Fed. Rep. of Germany

[21] Appl. No.: 168,331

[22] Filed: Jul. 14, 1980

Related U.S. Application Data

[63] Continuation-in-part of Ser. No. 147,291, May 6, 1980, abandoned, which is a continuation of Ser. No. 864,237, Dec. 27, 1977, abandoned.

[30] Foreign Application Priority Data

Dec. 24, 1976 [DE] Fed. Rep. of Germany ..... 2658770

[51] Int. Cl.[3] ..... F41D 11/00

[52] U.S. Cl. ..... 89/129 R; 89/42 B; 89/135

[58] Field of Search ..... 89/1 K, 129 R, 135, 89/42 B

[56] References Cited

U.S. PATENT DOCUMENTS 439,248 10/1890 Maxim ..... 89/129
636,975 11/1899 Garland ..... 89/129
3,537,353 11/1970 Nelson ..... 89/135
3,839,654 10/1974 Madelmont et al. ..... 89/135
3,991,650 11/1976 Garland et al. ..... 89/42 B

FOREIGN PATENT DOCUMENTS 228414 11/1910 Fed. Rep. of Germany ..... 89/42 B
1932081 1/1971 Fed. Rep. of Germany .
2300260 10/1976 Fed. Rep. of Germany .

OTHER PUBLICATIONS

How it Works, "The AND function," 1974, p. 1404.

*Primary Examiner*—Stephen C. Bentley

[57] ABSTRACT

A method for controlling the rate of firing from a machine gun having means for imparting energy to an ammunition feed system, a rigidly locking breech block and a firing device, and having a recoil and counter-recoil device which is movably coupled by means of a differential recoil system to the gun mount wherein the control order necessary for detonation is derived from the simultaneous transmittal of a signal from a predetermined position of the breech block and a predetermined position of the recoil counter-recoil device during its oscillating movement. Means are provided for adjusting the delay of the counter-recoil movement of the recoil counter-recoil device by limiting the travel of a control piston within the recoil counter-recoil device.

5 Claims, 4 Drawing Figures

METHOD AND MEANS FOR CONTROLLING THE FIRING RATE FROM A MACHINE GUN

CROSS-REFERENCE TO RELATED APPLICATION

This a Continuation-in-part of copending application Ser. No. 147,291, filed on May 6, 1980, now abandoned, which is in turn a continuation application of copending application Ser. No. 864,237, filed Dec. 27, 1977, now abandoned.

BACKGROUND OF THE INVENTION

The present invention relates to a method and means for controlling the rate of firing from a machine gun. The firing rate of a gun is an essential factor in achieving high fire power under sustained firing conditions.

In the case of machine guns which utilize a gas pressure drive system, methods for controlling the rate of fire are known (see, for example, German published applications No. AS2300260 and No. OS1932081). One such method uses a removable and replaceable nozzle of given cross-section located within the detonation chamber. The nozzle draws off a portion of the gas produced by the detonation to be used in the subsequent firing sequence. Variation in the rate of firing is achieved by changing the nozzle to one of different cross-section. Such control means suffers from the disadvantage of requiring dismantling and reassembly each time a change in the rate of firing is desired.

Another type of gas pressure drive system uses an electrical detonating system which utilizes a signal transmitter for indicating the locked position of the breech block and a drive for controlling the detonating current. The rate of firing is accurately selectable by impressing a control signal through a retriggerable monostable flip-flop having an adjustable response time. Although this device avoids the disadvantages of dismantling and reassembly operations required a nozzle control device, it requires a lengthy operation to locate any fault that may occur in the electrical system.

It is an object of the present invention to provide a rate of firing control system which not only avoids the disadvantages of known systems, but also enables fine adjustment of the rate of firing.

The present invention provides a method for controlling the rate of firing from a gun by constructing the recoil counter-recoil device as an oscillator, varying the oscillation characteristic of the device for optimum response and transmitting an order to detonate for the subsequent firing cycle when signals are present from the predetermined position of the recoil counter-recoil device during its oscillation and from the predetermined position of the breech.

The invention can be used both for floating and buffered carriage systems, with any form of propulsion (gas pressure, hybrid, recoil) and any type of construction, for example drum-type magazine weapons. A floating carriage system of the type referred to herein is disclosed in my U.S. Pat. No. 4,151,781.

A floating gun mount of the type referred to herein is also described and illustrated in WAFFENTECHNISCHES WOERTERBUCH published by the assignee of this application, fourth edition 1977 printed by Gesamtherstellung Broemers Druckerei Breidenstein KG., Frankfurt a.M., West-Germany, on pages 266–268 chapter 7.6 (the term of the art in the U.S. for the type of gun mount described in the aforesaid pages 266–268 is FOOB, fireout of battery or preferably differential recoil).

BRIEF DESCRIPTION OF THE DRAWINGS

Although such novel features believed to be characteristic of the invention are pointed out in the claims, the invention may be further understood by reference to the description following and the accompanying drawings. All details not essential to the invention have been omitted.

DETAILED DESCRIPTION

Figure 1:
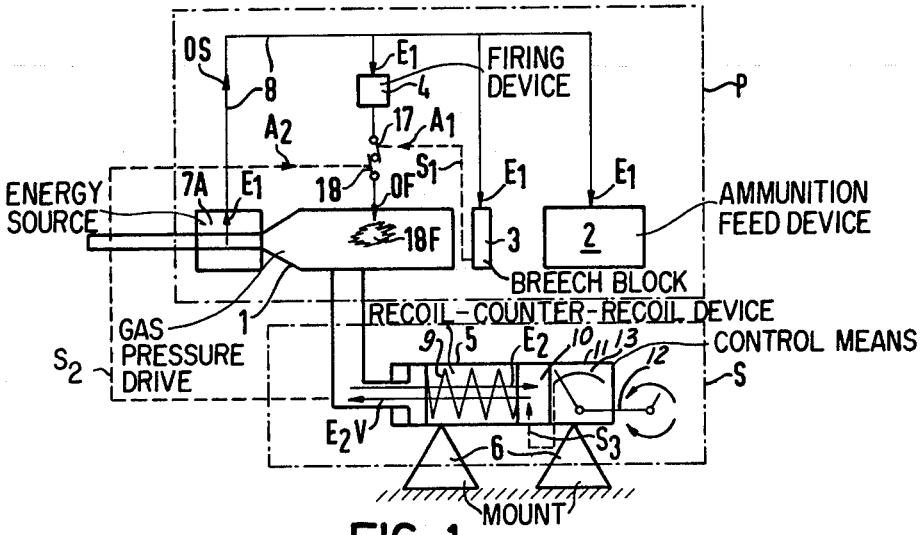
FIG. 1 is a block diagram of the invention for a gun employing a gas pressure drive system.

In the embodiment illustrated in FIG. 1, a gun employing a gas pressure drive 1 and provided with an ammunition feed device 2, a breech block 3, and a firing device 4, is resiliently coupled to a mount 6 by means of a recoil counter-recoil device 5. An energy source 7A, produced by the expansion of propulsion gas in the barrel of the gun during firing, is supplied to components 2, 3 and 4 via an energy transmission system 8. The recoil counter-recoil device 5 comprises means for receiving 9 and means for storing 10 energy $E_2$ produced by the recoil action of the gun and control means 11 for releasing the stored energy $E_2V$ thereby producing the counter-recoil action of the gun. Control means 11 comprises a timing element 13 variable by means of adjusting means 12. The firing device 4 comprises an energy source, not described in further detail, and is connected to a detonator within the gun, not shown, via serially connected normally open circuit breakers 17 and 18. A transmitter, not shown, for producing a signal $A_1$ when breech block is in its preferred position, i.e. in its locked position, is connected to circuit breaker 17 via line $S_1$. A second transmitter, not shown, for producing signal $A_2$ when the recoil counter-recoil device 5 has reached its optimum position is connected to circuit breaker 18 via line $S_2$.

The component parts which are directly associated with the gun and are essential to the operation of the gun in the present context form a first or primary unit and are shown in FIG. 1 enclosed in a dotted line P. The recoil counter-recoil device 5 forms a second unit shown in FIG. 1 enclosed in a dotted line S.

The method of operation of the system of the present invention occurs as follows:

The detonation action during the first firing cycle produces an energy impulse $E_1$ by the action of the expanding propulsive gas within the gun barrel, which is transmitted via transmission system 8 in the form of a control order OS to the relevant components 2, 3 and 4. As soon as the breech block 3 has reached a certain preselected position contact breaker 17 is closed by signal $A_1$. As a result of the recoil force of detonation a certain amount of potential energy $E_2$ is introduced into the recoil counter-recoil system S and stored therein. At a preselected time thereafter, the control means 11 releases, via line $S_3$, an amount of energy $E_2V$ for the forward counter-recoil motion. The forward counter-recoil motion produces a signal $A_2$ which closes circuit breaker 18. The closing of both circuit breakers 17 and 18 permits a control order OF emanating from the firing device 4 to arrive at the detonator in the gun and produce the firing action 18F for the subsequent firing cycle. The above process is repeated for sustained firing as long as a trigger, not shown, is actuated. The frequency of firing corresponds to the oscillation rate of the gun 1 with respect to the mount 6. By appropriately adjusting the timing element 13, the time at which energy $E_2V$ is released is predetermined and, in turn, the gun oscillation rate and the frequency of firing are established.

The advantageous manner in which the primary unit P is connected to the counter-recoil system S to form a closed feedback control system provides the advantage of having a reliable firing frequency control system based on simple means.

Figure 2:
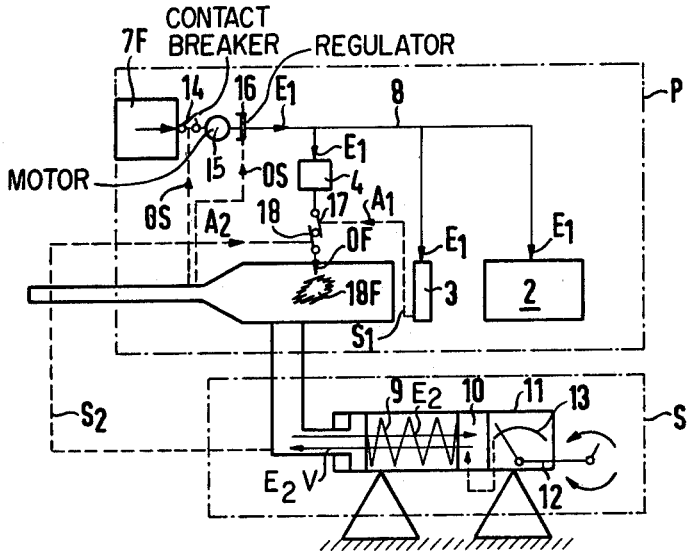
FIG. 2 is a block diagram of the invention for a gun employing an external drive system.
Figure 1A:
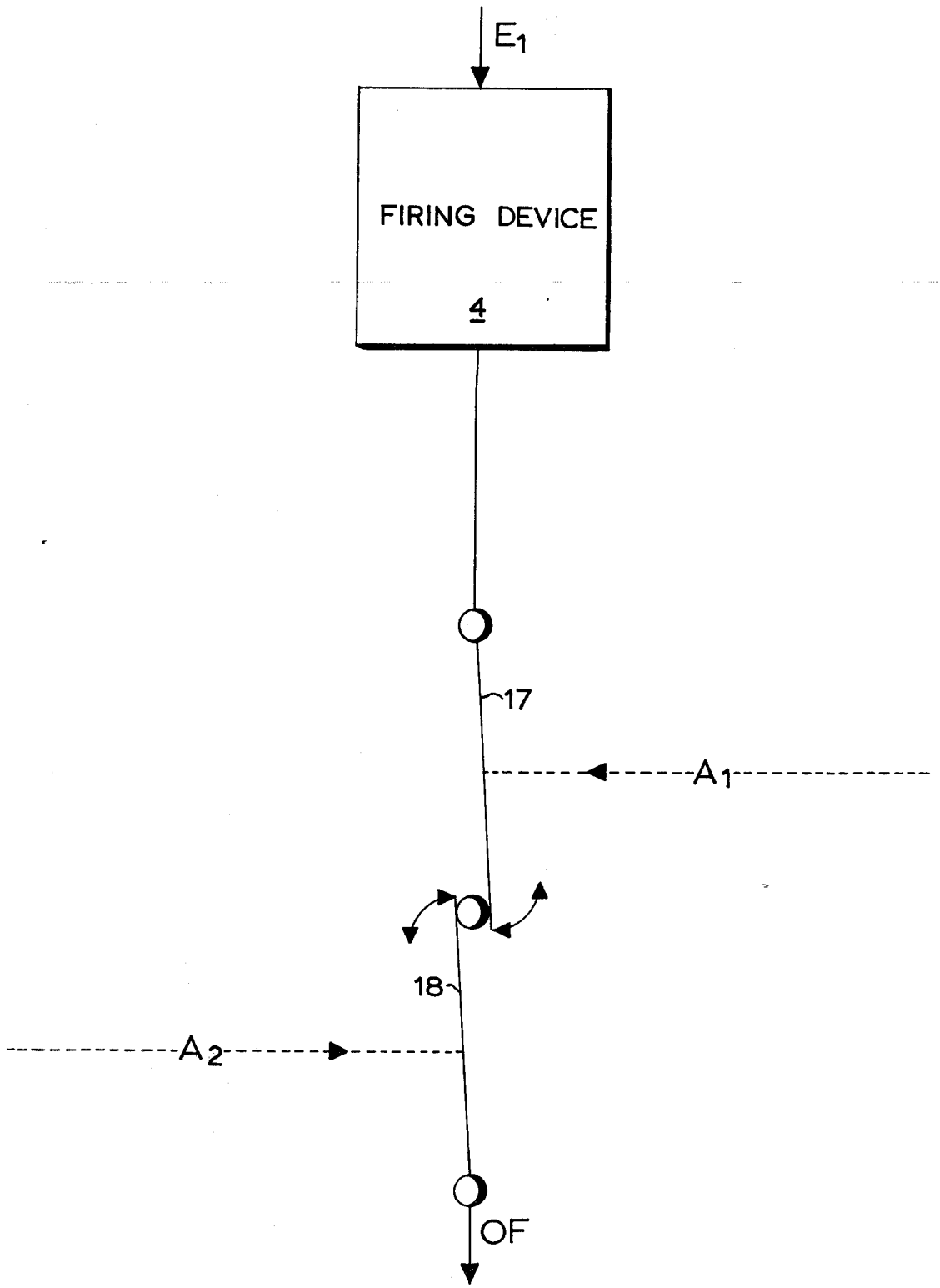
FIG. 1*a* is a detailed schematic view of the AND-gate in FIG. 1 when closed in condition, FIRING.

In the embodiment illustrated in FIG. 2, electrical energy is produced from an extraneous electrical source 7F and used to operate a motor 15. The output of the motor 15 is connected to an energy regulator 16 which controls and determines the energy $E_1$. A control order OS produced by the detonation actuates and thereby closes a contact breaker 14 connected to the input of the motor 15 thereby permitting the transmission of energy $E_1$ to components 2, 3 and 4 via the energy transmission system 8. In a preferred embodiment, the control order OS can also actuate the energy regulator 16 to assure a continuous regulated energy $E_1$. The loading capacity of electrical source 7F and the starting characteristics of the motor 15 will govern the choice of embodiments. The choice of the form of energy (electrical, hydraulic or pneumatic) will be governed by considerations not pertinent to the present invention. The method of operation of the embodiment shown in FIG. 2 is essentially the same as described above for the embodiment shown in FIG. 1.

Figure 3:
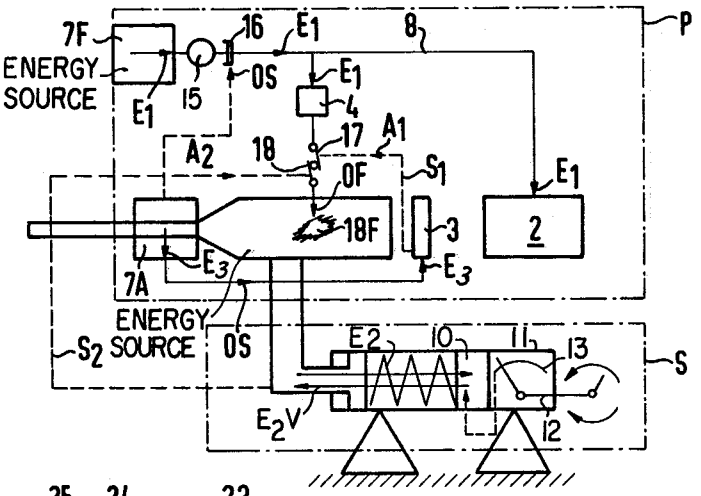
FIG. 3 is a block diagram of the invention for a gun employing a hybrid drive system.

FIG. 3 illustrates a hybrid drive system using two sources of energy, 7F and 7A. In this embodiment, the detonation action of the gun produces both a control order OS and an amount of energy $E_1$. The control order OS permits energy $E_1$ to be transmitted to components 2 and 4. Energy $E_3$ is used to release and operate the breech block 3. The method of operation of this system can be understood by the method of operation described for the embodiment shown in FIGS. 1 and 2.

Figure 4:
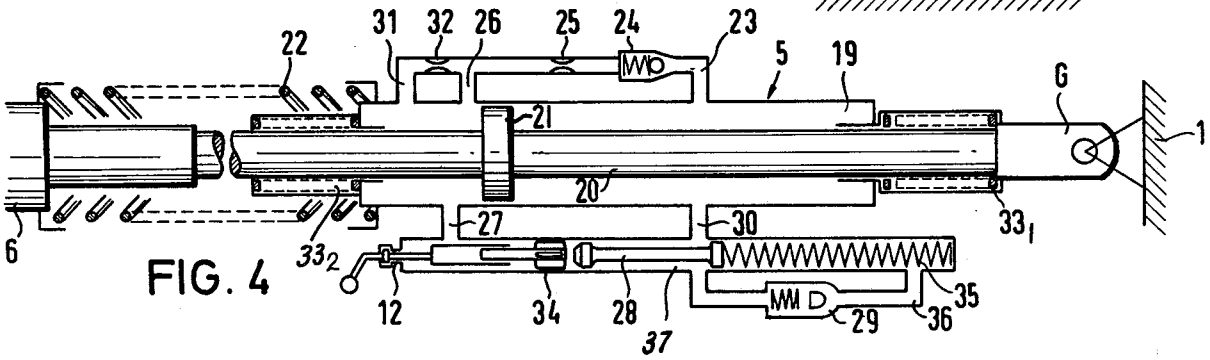
FIG. 4 is a longitudinal horizontal section of the recoil and counter-recoil portion of the present invention for a gun employing a floating mount system.

FIG. 4 depicts a longitudinal symmetrical half section of the recoil counter-recoil system 5 comprising a hydraulic cylinder 19 within which is disposed a piston 20 which is coupled to a piston rod 21 on both sides. The front end G of the piston rod 21 is fastened to a housing of the gun 1, while the rear of the piston rod 20 bears against the mount 6. A friction ring spring 33 is disposed at both the front and rear ends of the hydraulic cylinder 19. A spring 22, which is also disposed at the rear end of the hydraulic cylinder, rests against mount 6. Extending from the forward portion of the hydraulic cylinder 19 is hydraulic line 23. A non-return valve is connected to line 23, which is in turn connected to a throttle 25. The throttle 25 is connected to parallel hydraulic lines 26 and 31, between which is disposed a diaphragm 32. The parallel lines 26 and 31 are thence connected to a rearward portion of hydraulic cylinder 19. Thus lines 23, 26 and 31 act as a hydraulic feedback loop. A cylindrical guide 37 within which is disposed control piston 28 is connected at its ends to the opposite side of hydraulic cylinder 19 through lines 27 and 30. A limiting device 34, adjustable by control means 11, is disposed at the rear of the control piston 28. A spring 35 is disposed at the front end of the control piston 28 within a cylindrical guide. A line 36, within which is disposed a unidirectional diaphragm 29 extends from the cylindrical guide as a closed feedback loop the flow-through area from left to right past diaphragm 29 is larger than in the opposite direction as seen in FIG. 4. The hydraulic cylinder 19 and the lines connected thereto, as well as the hydraulic guide 37, are filled with hydraulic fluid.

The recoil action occurring as a result of detonation of the gun causes energy to pass into the recoil counter-recoil system 5. The piston 20 moves toward the right as seen in FIG. 4, displacing the fluid situated in front of it and subjecting the spring 22 to longitudinal bias. The displaced fluid flows through the connection 23, passes through the non-return valve 24 and the throttle 25, and flows into the hydraulic cylinder 19 on the other side of the piston 21 via the connection 26. During this flow, particularly when the fluid passes through the throttle 25, it absorbs heat. Through a combination spring action, storage action and the conversion of recoil energy into heat emitted to the fluid, the supporting force acting on the mount 6 can be kept constant over the entire recoil movement.

The counter-recoil action occurring as a result of the restoring force of spring 22 causes piston 21 to move toward the left, displacing the fluid in front of it. The non-return valve 24 prevents fluid from entering line 23 and flowing into hydraulic cylinder 19 through that path. The fluid is therefore diverted through connection 27 and moves the control piston 28 against spring 35. The fluid surrounding the spring 35 is displaced through the line 36 and moves to the opposite side of piston 20, via diaphragm 29, effective in this direction only, and via the connection 30. During this process the piston 20 and thus the gun 1 cover a short forward path in a relatively long period. The length of the period is governed by the particular effects exerted by the control piston 28 and the diaphragm 29. Once piston 28 has traversed its path, the connecting line 30 permits the passage of fluid to the front of piston 21 and only slight resistance opposes the flow. The gun 1 is able to absorb kinetic energy as it continues its forward motion. The fluid can then be diverted via connection 31 and forced through the diaphragm 32 and the connection 26. The kinetic energy inherent in the gun 1 as it continues its counter-recoil motion is finally taken up by the friction ring spring 33 at the end of the counter-recoil path.

The oscillating characteristics can be altered by varying the control path traversed by the control piston 28. This is accomplished by adjusting the limiting device 34 by means of the control element 12 (see FIGS. 1-3). By providing a transmitter for the signal $A_2$ from the forward counter-recoil motion, a simple and reliable means of finely controlling the firing rate is achieved.

In a recoil loader, not shown, which is generally mounted on the buffered system, an energy $E_1$, serving to actuate the ammunition feed system 2, is formed from part of the recoil energy. The oscillation characteristics are modified by changing the amplitude of the forward and return path in such a way that the distance between a counter-recoil buffer and a recoil buffer is adjustably altered.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

I claim:

1. An improved arrangement for controlling the rate of firing of fire bursts in a machine gun having a breech block, an ammunition feed device and a recoil and counter-recoil device for elastically coupling the gun to gun mount by means of a differential recoil system so as to enable the gun to oscillate with preselected oscillation characteristics during firing said gun emitting energy impulses during firing of a shell which are operatively conducted by conduit means to produce ignition of the following shell fed into the gun by the ammunition feed device, the improvement comprising:

receiving means and storing means operatively mounted in said recoil and counter-recoil device said storing means being adapted to store the recoil energy of the gun during recoil thereof, control means operatively connected to said storing and receiving means, said control means having a timing element and being adapted to selectively release a predetermined amount of energy for the counter-recoil motion;

adjusting means operatively connected to said control means for adjusting said timing element;

a primary transmitter operatively associated with said breech block to emit a first signal at a preselected position of said breech block;

a secondary transmitter operatively associated with said recoil and counter-recoil device for emitting a second signal at a preselected position of said recoil and counter-recoil device; and a relay in said conduit means adapted to conduct an energy pulse emitted from the gun during firing of a shell to initiate ignition of the following shell in the breech block when said first and second signals have placed said relay in a conductive state;

said primary and secondary energy transmitters being operatively coupled to said conduit means.

2. An improved arrangement for controlling the cadence of firing bursts in a machine cannon having a loading chamber, a differential recoil gun mount including a reciprocally movable breech block and a dampening system which include biasing means which include mechanical as well as hydraulic means for receiving and storing recoil energy which forms during firing of a projectile from said machine cannon and adjustable means operatively connected to said dampening system for selectively releasing predetermined amounts of said energy for the counter-recoil movement of the machine cannon, and means operatively mounted in said machine cannon for controlling the movement of the breech block independently from the recoil and counter-recoil movement of the gun barrel, the improvement comprising in combination, (a) said dampening system is formed by a recoil-counter-recoil system which operatively couples the machine cannon to the gun mount;

(b) said recoil-counter-recoil system includes means for adjusting the counter-recoil movement of the machine cannon;

(c) said adjusting means includes an adjustable timing element which is adapted to release the stored recoil energy at a predetermined point in time of the firing cycle;

(d) ignition means are operatively connected to the loading chamber of the machine cannon via an electrical ignition energy conduit in which there are disposed two circuit breakers in series;

(e) a first circuit breaker of said two circuit breakers being operatively connected to said breech block so as to close when said breech block is in a locked position and a second circuit breaker of said two circuit breakers being controlled by the recoil-counter-recoil system so as to close at a predetermined point in time of the counter-recoil movement thereof; and (f) said two circuit breakers forming jointly an AND-gate for conducting adequate ignition energy from said ignition means via said electrical ignition energy conduit and said AND-gate to said loading chamber to ignite the propellant charge of a projectile disposed therein.

3. The improvement in the arrangement for controlling the cadence of firing bursts in a machine cannon as set forth in claim 2, wherein (a) said recoil-counter-recoil system includes a first hydraulic cylinder, a first piston axially movably mounted therein, said first piston having a pair of piston rods axially extending in opposite directions from opposite sides of said first piston;

(b) the free end of one of said two piston rods is connected to said machine cannon and the free end of the other of the two piston rods is mounted on the gun mount;

(c) said first hydraulic cylinder having a plurality of exterior branch conduits in mutual communication with the first hydraulic cylinder and each other;

(d) said adjustable timing element and adjusting means being operatively mounted or connected with said plurality of branch conduits.

4. The improvement in the arrangement for controlling the cadence of firing bursts in a machine cannon as set forth in claim 2, wherein (a) a second piston is reciprocally axially movably mounted in one of said branch conduits, said timing element being operatively connected to said second piston;

(b) a flow limiting device is operatively mounted in one of said branch conduits and adapted to coact with said second piston;

(c) said adjustable timing element adjusts the preselected limits between which the flow limiting device is axially movable and fixable in said branch conduit; and (d) by means of preselectively positioning the flow limit device the length of the operative path traversed by said second piston in the branch conduit is closed and opened at preselected points in time.

5. The improvement in the arrangement for controlling the cadence of firing bursts in a machine cannon as set forth in claim 4, wherein (a) a coil spring is operatively connected to said second piston to bias it towards said flow limit device;

(b) said branch conduit includes a portion which forms a longitudinal extension of the branch conduit in which said second piston is reciprocally movable, said coil spring is disposed in said longitudinal extension and the operative path of said second piston partially extends into said longitudinal extension;

(c) said second piston having a front and rear portion of equal diameters which are connected to each other by a rod of smaller diameter than the diameters of the front and rear portions;

(d) said longitudinal extension of said branch conduit including a second branch conduit of its own, throttling means mounted in said second branch conduit, the effective cross-section of said throttling means depending on the direction of flow therethrough; and (e) said second branch conduit extending from the free end of said longitudinal extension adjacent to one end of said coil spring.

* * * * *